United States Patent [19]

Ludwig

[11] Patent Number: 5,070,912

[45] Date of Patent: Dec. 10, 1991

[54] AIR JET WEAVING LOOM WITH EXPANDER ELEMENT AND SPREADER TABLE

[75] Inventor: Hubertus Ludwig, Lindau-Bodolz, Fed. Rep. of Germany

[73] Assignee: Lindauer Dornier Gesellschaft mbH, Lindau, Fed. Rep. of Germany

[21] Appl. No.: 564,746

[22] Filed: Aug. 8, 1990

[30] Foreign Application Priority Data

Aug. 10, 1989 [DE] Fed. Rep. of Germany ..... 3926525

[51] Int. Cl.[5] ..... D03D 49/60

[52] U.S. Cl. ..... 139/188 R; 139/192; 139/291 R; 139/435.1

[58] Field of Search ..... 139/292, 435.1, 192, 139/188 R, 291 R, 294

[56] References Cited

U.S. PATENT DOCUMENTS 3,620,260 11/1971 Bourlet ..... 139/292
3,800,835 4/1974 Riha et al. ..... 139/291 R
3,885,600 5/1975 Altmann ..... 139/292
4,919,171 4/1990 Dornier ..... 139/435.1
4,951,717 8/1990 Riezler ..... 139/435.1

*Primary Examiner*—Andrew M. Falik
*Attorney, Agent, or Firm*—W. G. Fasse

[57] ABSTRACT

An air jet weaving loom is equipped with at least one expander element and a spreader table, whereby the spreader table surrounds a spreader in a trough and has an extension (8) in a forward fabric guidance area pointing toward the middle of a weft thread insertion channel, so that the top surface of the extension increases the fabric supporting surface of the spreader table. One expander element (20) is located in the spreader table (7) in a transition region between an edge of the trough of the spreader table (7) and the extension (8). Another expander element (21) may be located along an exit edge of the trough of the spreader table. Both expander elements (20, 21) have a fabric expander profile that extends at least along the margin zones of the fabric.

9 Claims, 5 Drawing Sheets

AIR JET WEAVING LOOM WITH EXPANDER ELEMENT AND SPREADER TABLE

FIELD OF THE INVENTION

The present invention relates to an air jet weaving loom with a reed and a weft thread insertion channel arranged in the reed and having a spreader table arranged in front of the reed.

BACKGROUND INFORMATION

Air jet weaving looms of the kind mentioned above are used to manufacture particularly fine fabrics. The trend in weaving is toward finer and finer fabris, i.e. material with fine thread and a high weft density. For this purpose it is known to extend the spreader table as far as possible into the weft insertion channel. See U.S. Pat. Nos. 4,919,171 (Dornier) and 4,951,717 (Riezler).

In the processing of such fabrics it became apparent that a strong contraction takes place, especially along the margin area of the web, i.e. the margin the fabric contracts more than the central area of the fabric, leading to an undesirable shrinkage of the fabric width so that the running characteristic is impaired due to breakage of warp threads in the margin area. This also reduces the quality of the fabric and hence the effectiveness and productivity of the machine. For these reasons it has been impossible to exceed a lower limit with regard to fineness of the yarn and the weft density.

OBJECT OF THE INVENTION

The present invention therefore has for its object to improve an airjet weaving loom of the described type so that the finest yarns can be processed with a high weft density in a reliable manner while an excellent fabric quality remains assured.

SUMMARY OF THE INVENTION

For achieving the above object the invention is characterized by an expander element integrated in a spreader table in the transition region between the spreader table and an extension and by the fact that the expander element at least covers the margin zone of the fabric web. An important advantage of the present invention is the fact, that the present expander element shortens the distance between the beat-up point of the web and the engagement point of the spreader.

It has been found that the usual spreader assures a spreading effect only after a particular wrap around angle, i.e. the fabric, before entering the spreader as viewed from the beat-up point, runs over some distance without guidance and without any spreading effect, resulting in a contraction of the web in this area.

In accordance with the invention, the expander element is provided just in this area for reducing the contraction length so much, that no significant contraction effect takes place.

The point where spreading is effected is transferred forward in accordance with the invention as compared to known spreaders where it became effective only after a certain wrap-around angle on the spreader in the range of, i.e. 60–90 degrees. Because of the position of the expander element in accordance with the invention, the spreading is now moved forward toward the beat-up point and the undesirable contraction in the margin zones is substantially avoided. Thus, for the first time, the processing of fine fabrics with a high weft density and highest product quality is possible.

In a further embodiment of the present invention an expander element corresponding to the invention is placed not only at the forward entrance, but also at the rearward exit from the spreader table.

Through the provision of a rearward expander element the load of the needle spreader is reduced. Such load reduction is achieved when an expander element is placed on the exiting edge where it performs a guiding function in the direction of the width of the fabric so that the fabric is spread out and does not contract in an undesirable way. Particularly, in the case of using needle spreaders, this feature avoids that the radially protruding needles of the spreader tear holes into the fabric when they exit from the fabric web.

Such tearing effect mostly occurs in the finest fabrics having high weft densities, so that the arrangement of an expander element at the exit side provides a significant improvement also in this situation.

In accordance with the present invention, a further advantage is achieved in that the fabric, which reaches the spreader table essentially in the direction of the warp in the area where the fabric is guided, is moved in such a way that a spreading takes place which counteracts the undesirable contraction in the margin zone. The spreading effect by the expander element in accordance with the invention can be achieved through several embodiments.

A first preferred embodiment provides that the expander element is a fixed element in the form of a rod which on its surface has an appropriate guidance profile such as a threading.

Such guidance profile elements can be constructed in various forms, such as guidance ribs, guidance grooves, or separate guidance elements attached to, but not part of the material of the rod.

A further preferred embodiment of an expander element in accordance with the invention, is in the form of a threaded rod, whereby the pitch and the direction of the pitch is chosen, so that the desired spreading effect is achieved. The present invention includes the case where the thread flanks of the expander rod are inclined to the warp direction, but in themselves are straight. In a further embodiment the thread flanks also run inclined to the warp direction but are curved, whereby the spreading effect is changed.

In a further embodiment of the present invention it is preferred that the profile guidance function of the expander element changes or varies along the length of the expander element.

In this case it is preferred that a higher guidance function, or a better guidance function, is provided at the outer margin of the expander element, i.e. in the margin area of the fabric, as compared to the middle of the fabric.

As is known, it is the undesirable contraction in the selvage area which should be eliminated as much as possible. To achieve this purpose, it is a prerequisite that the spreading effect of the expander element is large in the margin areas of the fabric while it need not be so strong in the remaining central areas of the fabric. For this reason, the profile elements of the expander element can be provided with a better or stronger guidance function in the margin area as compared to other areas of the expander element.

With regard to the length of the expander element, there are also different forms of embodiments.

A first embodiment provides that the expander element itself is only positioned in the outer margin area of the spreader table while in the other guidance areas, particularly in the middle of the fabric, no expander element is located.

A second embodiment provides that the expander element extends over the entire fabric width whereby, corresponding to the explanation above, either a constant guidance effect is provided over the entire length, or the guidance effect varies over the length.

BRIEF DESCRIPTION OF THE DRAWINGS

In the following, the invention is explained in detail by way of example with reference to the accompanying drawings, wherein.

DETAILED DESCRIPTION OF PREFERRED EXAMPLE EMBODIMENTS AND OF THE BEST MODE OF THE INVENTION

Figure 1:
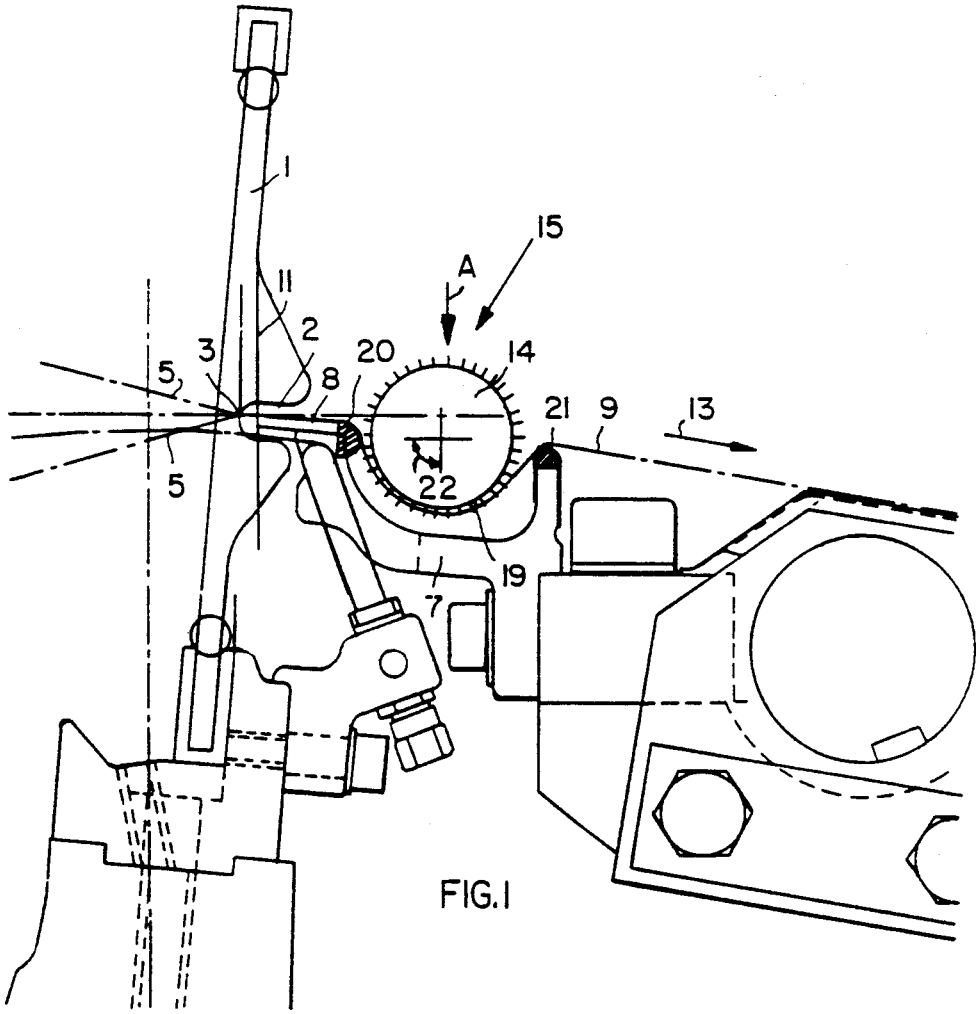
FIG. 1 shows schematically a side view of an air jet weaving loom in its beat-up position.

FIG. 1 shows a reed tooth 1 with a weft thread insertion channel 2 arranged therein. The warp threads 5 run together in the area of the weft insertion channel 2 and there at the beat-up or binding point 3 form the fabric 9.

Downstream of the beat-up point or line 3 a spreader table 7 is positioned, either fixed or tiltable, on the loom.

As is known for example from U.S. Pat. Nos. 4,919,171 (Dornier) or 4,951,717 (Riezler), the spreader table 7 is extended into the weft thread insertion channel 2 by an extension element 8. This, however, is not limiting for the present invention as it is only important for the invention that an expander element 20 is positioned in the run-in area, that is, in the area of the guide edges of the spreader table 7. The expander element 20 is connected to the spreader table 7 by conventional elements, e.g. screws.

The function of this expander element 20 will be described in more detail below.

Further, a needle cylinder 14 is rotatably supported by the spreader table 7. The needles of the needle cylinder 14 reach into the fabric, whereby, in a known fashion, a guidance effect, i.e. a spreading effect, is applied to the fabric in the angular range 22. The fabric then runs over the needle cylinder 14 and in the fabric feed direction of arrow 13 toward a fabric take-up.

FIG. 1 also shows a further expander element 21 in the exit area of the spreader table 7, so that the fabric is again spread out after it leaves the spreader channel 19 at the exit of the needle cylinder. The expander element 21 is also connected by conventional elements to the table 7, e.g. screws.

Instead of the needle spreader 14 shown here, other types of spreaders can be used, i.e. rod spreaders or similar known spreader types.

Figure 2:
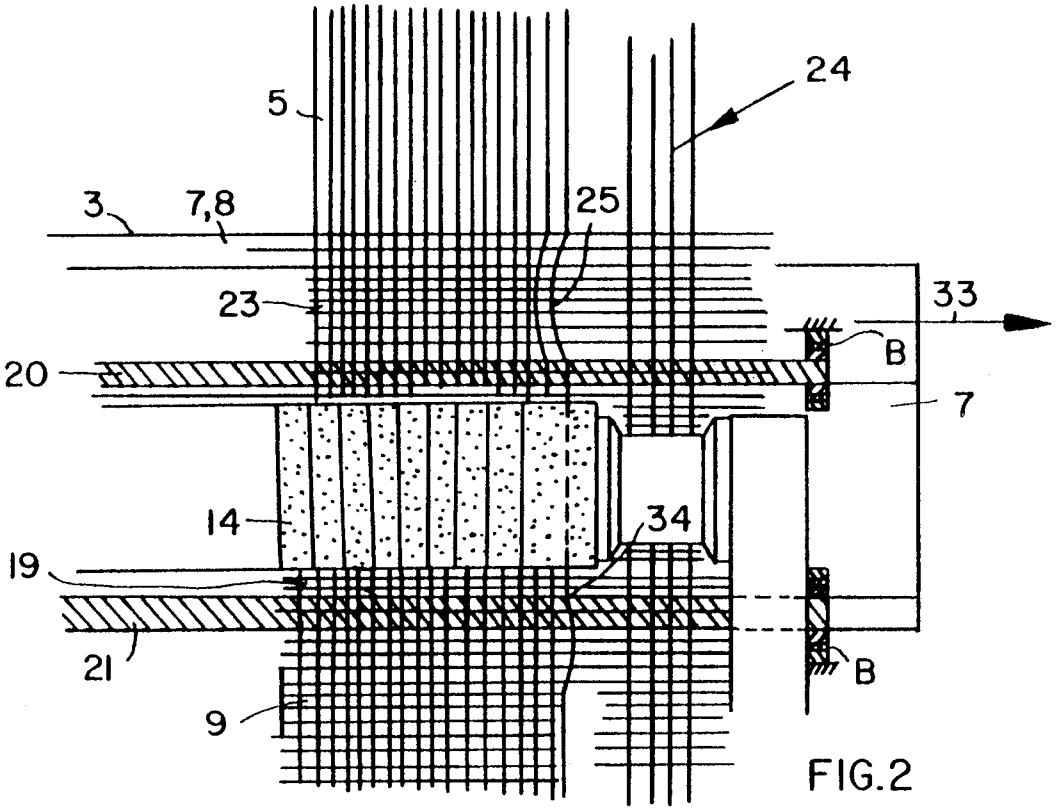
FIG. 2 is a top plan view of the fabric spreading components of a loom as viewed in the direction of arrow A in FIG. 1.

FIG. 2 shows in detail the spreading effect of the expander element 20 at the run-in side. It can be seen that beyond the beat-up point 3 the warp threads 5 enter the spreader table 7 and that upstream of the spreader, as viewed in the roll-up direction, the fabric 23 is subject to an undesirable contraction 25 forming a type of waistline, especially in the fabric margin area. The provision of an expander element 20 in accordance with the invention, practically eliminates this contraction 25.

FIG. 2 also shows the further expander element 21 provided at the exit side of the spreader table 7 downstream of the needle cylinder 14, which assures a similar spreading effect. A similar contraction 34 can be seen to occur at the exit of the fabric channel 19. This contraction is eliminated by the rearward expander element 21.

Figure 3:
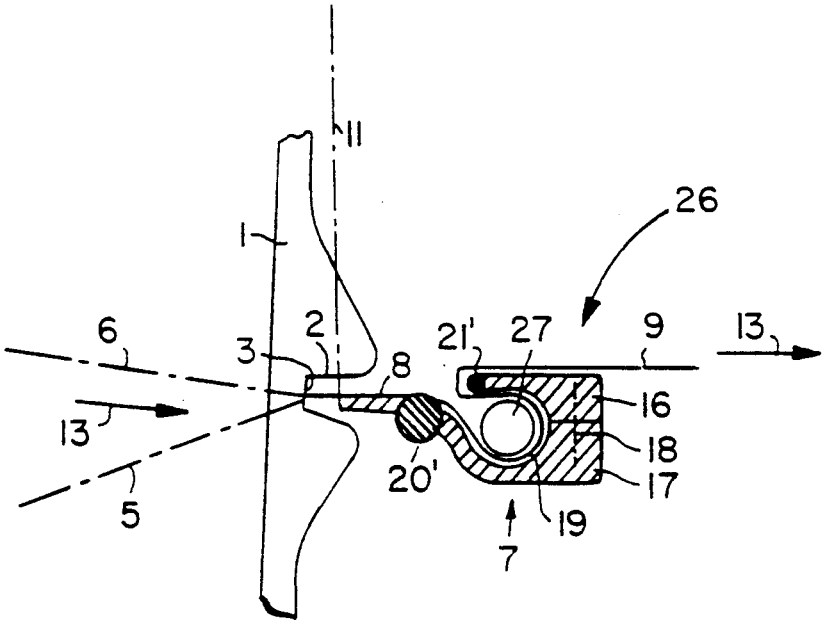
FIG. 3 shows schematically a cross-section through a second spreader embodiment.

FIG. 3 shows another embodiment of a spreader, i.e. a rod spreader 26. The rod spreader comprises a spreader 26, table 7 with a cover 16 which is attached to a bottom part 17 by a fastener 18, not further detailed, whereby the cover 16 and bottom part 18 form a channel holding a spreader rod 27. Aligned with line 11 passing substantially vertically through the center of the weft thread insertion channel 2, is an, edge of the extension element 8 of the spreader table 7 whereby the table 7 reaches into the weft thread insertion channel 2 and is centered with its front edge approximately in the middle of the weft thread insertion channel. Incidentally, the just described relationship between the extension element 8 and the channel 2 also exists in FIG. 1. In accordance with the invention, the expander element 20' in FIG. 3 is mounted to the entrance guiding edge of the extension element 8 of the spreader table.

In addition, an exit expander element 21' is mounted to the exit guidance edge of the cover 16 of the spreader table.

Figure 4:
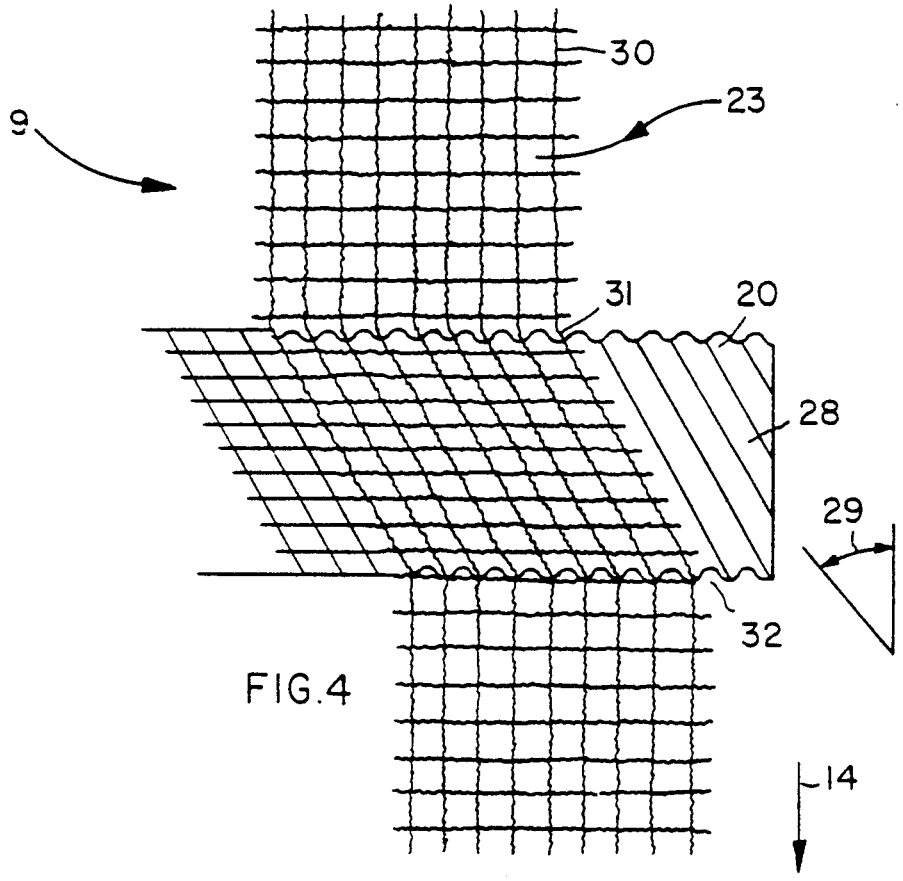
FIG. 4 schematically illustrates on an enlarged scale a top view of the spreading effect of an expander element in accordance with the invention.

FIG. 4 further details the spreading effect, whereby it is not important what type of spreader is arranged downstream of the expander element 20 or 20'.

It can be seen from FIG. 4, that the fabric 9 can be of any kind of yarn. For the purpose of the illustration the yarn is shown in a zig-zag arrangement, to better present the passage over the expander element 20 or 20'.

The fabric 23 in front of the spreader runs straight in the direction of the warp threads onto the expander element 20. For reason of simplicity, the contraction 25 which occurs toward the fabric margin is not depicted.

As shown in FIG. 4, at the entrance region 31 to the expander element 20 there is a change in the direction indicated by the arrow 33 (FIGS. 2 and 6); i.e. the fabric is spread out toward the selvage 24 as indicated by the arrow 33 in FIG. 2.

The spreading occurs because the fabric is guided by the inclined profile flanks 28 which have a pitch 29 to the vertical. This pitch is chosen, so that the respective spreading effect counteracts the contraction 25 of the fabric 23.

Figure 7:
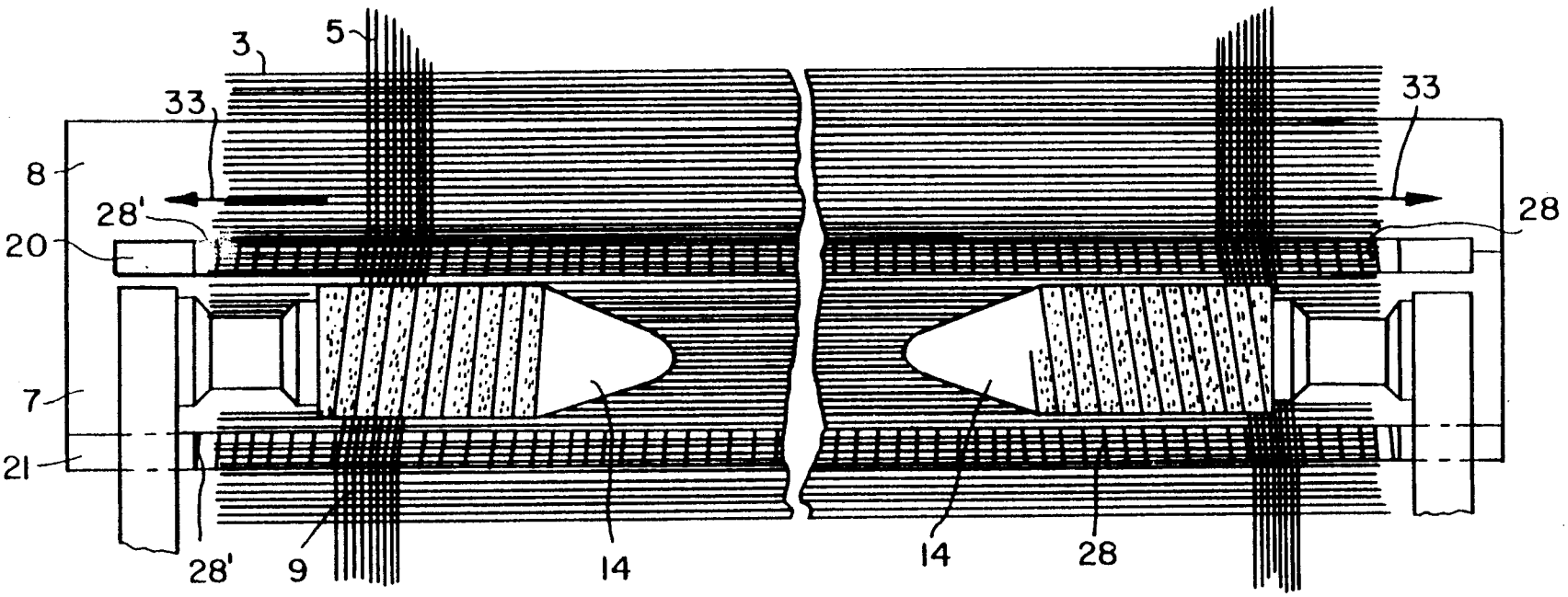

On the left fabric margin it is therefore necessary to provide a mirror image FIG. 7, wherein the profile flanks 28 at the right hand end of the expander elements 20 and 21 slant from left to right while the profile flanks 28' at the left hand end of the expander elements slant from right to left so that the fabric expanding characteristic of the expanding profile changes along the length of the expander elements 20, 21 arrangement as shown in FIG. 4. At the exit region 32 the fabric is thus spread out and enters in this form the needle cylinder 14 merely shown as an arrow in FIG. 4.

Figure 5:
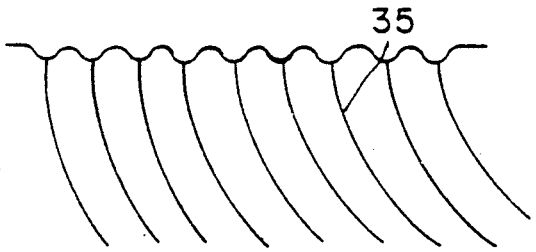
FIG. 5 shows a simplified view of a thread form of another embodiment of an expander element.

FIG. 5 shows that not only straight, inclined profile flanks 28 can be used, but also curved profile flanks 35 can be used for the expander element 20, 21.

Figure 6:
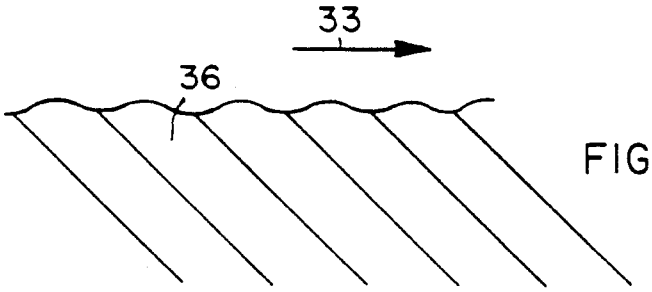
FIG. 6 shows a simplified view of still another form of thread for the expander element and FIG. 7 is a view similar to FIG. 2, but showing both margins of the fabric, whereby the orientation of a guidance profile at one end of an expander element is opposite to the orientation of the respective profile at the other end of the same expander element.

FIG. 6 shows straight profile flanks 36 for an expander element 20, 21, whereby the density of the profile flanks that is the spacing between the neighboring profile flanks 36 increases in the direction of arrow 33 i.e. toward the edge of the fabric. As a result, a stronger spreader effect is achieved in the margin area than in the areas further away from the margin of the fabric.

As mentioned above, a simple embodiment of the expander element comprises a threaded rod having profile flanks 28 with a metric or "fine" threading. Experiments by the applicant have shown that for space saving reasons a threaded rod with a diameter of 3 mm and a thread M3 can be used, whereby a right-hand thread is used at the right fabric margin, and a left-hand thread at the left fabric margin as shown in FIG. 2.

The form of the thread for the exit area expander element 21 must be chosen accordingly, that is corresponding to the desire spreading effect, a left-handed or right-handed thread must be used.

Above it was mentioned that the expander element was stationary firmly attached in the guiding edges of the spreader table 8.

A further embodiment of the present invention provides rotating expander elements supported in corresponding bearings B as shown in FIG. 2, where the bearings B are mounted near the end of the spreader table 7. Rotatable profile flanks, for example, in the form of rollers, wheels or other profiled elements are mounted on a shaft.

In another embodiment of the present invention the expander elements 20, 21 is rotationally driven, whereby it is important that in the example of a right-handed thread, as appropriate for the right margin, the drive of the expander element is counterclockwise, so that the spreading effect is in the direction toward the fabric margin. Stated differently, a thread flank which receives the fabric in the run-in area 31 moves in a spiral form in the direction toward the fabric margin, thereby enhancing the spreading effect.

Although the invention has been described with reference to specific example embodiments it will be appreciated that it is intended to cover all modifications and equivalents within the scope of the appended claims.

I claim:

1. An air jet weaving loom with a reed forming a weft thread insertion channel, comprising a spreader table forming an upwardly open trough, said trough having an extension reaching into said weft thread insertion channel when said reed is in its beat-up position, said extension increasing a fabric supporting surface of said spreader table, fabric spreader means (14) in said trough for spreading a fabric as it passes through said trough, at least one fabric expander element (20) forming part of said spreader table in a transition area between said extension and said trough, said fabric expander element (20) comprising a rod having a fabric expanding profile in its fabric contacting surface at least where said fabric contacting surface contacts margin zones of a fabric being woven for expanding said fabric margin zones laterally outwardly to avoid inward contractions (25) of said fabric margin zones.

2. The air jet weaving loom of claim 1, wherein said fabric expanding profile comprises a threading having straight thread flanks (28, 36) extending at a slant relative to a fabric feed direction (13).

3. The air jet weaving loom of claim 1, wherein said fabric expanding profile comprises a threading having curved thread flanks (35), said curved thread flanks extending at a slant relative to a fabric feed direction (13).

4. The air jet weaving loom of claim 1, wherein said fabric expanding profile has a fabric expanding characteristic that changes along a length of said fabric expander element.

5. The air jet weaving loom of claim 4, wherein said fabric expanding characteristics of said fabric expanding profile increase from a fabric center zone toward each fabric margin.

6. The air jet weaving loom of claim 1, comprising a further fabric expander element (21) forming part of said spreader table on a rear wall of said trough where said fabric leaves said spreader table in a feed direction (13).

7. The air jet weaving loom of claim 6, wherein said expander element (20) and said further expander element (21) are rigidly secured to said spreader table.

8. The air jet weaving loom of claim 6, further comprising means for rotatably supporting said expander elements (20, 21) on or in said spreader table.

9. The air jet weaving loom of claim 8, wherein said means for rotatably supporting said expander elements comprise bearings (B).

* * * * *